US010047559B2

(12) United States Patent
Johansson

(10) Patent No.: US 10,047,559 B2
(45) Date of Patent: Aug. 14, 2018

(54) PLATFORM LADDER APPARATUS

(71) Applicant: Vare Invent AB, Glumslov (SE)

(72) Inventor: Rolf Johansson, Glumslov (SE)

(73) Assignee: Vare Invent AB, Glumslov (SE)

( * ) Notice: Subject to any disclaimer, the term of this patent is extended or adjusted under 35 U.S.C. 154(b) by 0 days.

(21) Appl. No.: 15/275,774

(22) Filed: Sep. 26, 2016

(65) Prior Publication Data

US 2018/0066474 A1 Mar. 8, 2018

(30) Foreign Application Priority Data

Sep. 7, 2016 (SE) ..... 1651198

(51) Int. Cl.
*E06C 1/393* (2006.01)
*E04G 5/14* (2006.01)
(Continued)

(52) U.S. Cl.
CPC ..... *E06C 1/393* (2013.01); *E04G 5/14* (2013.01); *E06C 1/04* (2013.01); *E06C 1/397* (2013.01)

(58) Field of Classification Search
CPC . E06C 1/393; E06C 1/04; E06C 1/397; E06C 7/16; E06C 7/48; E04G 5/14
See application file for complete search history.

(56) References Cited

U.S. PATENT DOCUMENTS 1,015,123 A * 1/1912 Bauer ..... E06C 7/16 182/107
2,597,902 A * 5/1952 Roketa ..... E06C 7/48 182/214

(Continued)

FOREIGN PATENT DOCUMENTS

CA 2305199 A1 4/1994
DE 19908063 A1 8/1999

(Continued)

OTHER PUBLICATIONS

EASI-DEC Access Systems Ltd, "Platform Ladder" Product brochure, www.easi-dec.co.uk, 2 pages, United Kingdom.
Swedish Patent and Registration Office, Swedish Search Report, dated Apr 6, 2017, p. 1-3.
European Patent Office, "European Search Report," dated Jan. 11, 2018, pp. 1-8.

*Primary Examiner* — Daniel P Cahn
*Assistant Examiner* — Shiref M Mekhaeil
(74) *Attorney, Agent, or Firm* — David J. Pitman; Fulwider Patton LLP

(57) ABSTRACT

A platform ladder apparatus (2) has a transport position and a use position in which the apparatus is arranged to lean against a wall (W) for performing work at an elevated level. The apparatus (2) has a ladder (4) and a working platform (20). A proximal side of the platform is pivotally connected at an upper end of the ladder such that it may be pivoted towards the ladder (4) to a stowed position essentially parallel to the ladder (4). The apparatus further comprises a pair of wall support arms (80) for stabilizing the apparatus in the use position in relation to the wall. The wall support arms (80) are connected to the platform (20) for movement between a stowed arm position in which the arms (80) project out from a distal side (24) of the platform (20) thereby preventing use of the apparatus, and a stabilizing arm position in which the arms (80) project sideways from the platform (20) in opposite lateral directions, respectively, for stabilizing the apparatus (2) in relation to the wall (W).

8 Claims, 9 Drawing Sheets

(51) Int. Cl.
*E06C 1/04* (2006.01)
*E06C 1/397* (2006.01)

(56) References Cited

U.S. PATENT DOCUMENTS 2,749,008 A * 6/1956 Wilson ..... E06C 7/16 182/116
3,336,999 A * 8/1967 McSwain ..... A45F 3/26 182/106
3,508,628 A * 4/1970 Conrad ..... E06C 7/423 182/172
3,734,236 A * 5/1973 Houtler ..... E06C 7/48 182/121
3,773,143 A * 11/1973 Del Prete ..... E06C 7/48 182/214
4,394,887 A 7/1983 Spinks
4,440,263 A * 4/1984 Smith ..... E06C 7/16 182/107
5,113,973 A * 5/1992 Southern ..... E06C 7/48 182/107
5,121,814 A * 6/1992 Southern ..... E06C 7/48 182/111
5,590,738 A * 1/1997 Hunt ..... A01M 31/02 182/116
6,997,283 B2 * 2/2006 Wollenberg ..... E06C 7/48 182/107
7,168,521 B1 * 1/2007 Murray ..... A01M 31/02 182/116
8,251,180 B1 * 8/2012 Paige ..... E06C 7/48 182/107
9,010,491 B2 4/2015 Trang
2005/0023084 A1 * 2/2005 Lazarus ..... E06C 7/48 182/214
2005/0072629 A1 * 4/2005 Brygger ..... E06C 1/397 182/107
2006/0086570 A1 * 4/2006 Wollenberg ..... E06C 7/48 182/107
2009/0107765 A1 * 4/2009 Germond ..... E06C 7/423 182/172
2009/0229918 A1 * 9/2009 Moss ..... E06C 1/18 182/129
2010/0213007 A1 * 8/2010 Richards ..... E06C 1/08 182/107
2012/0168250 A1 7/2012 Baglin
2014/0318894 A1 * 10/2014 Chow ..... E06C 7/48 182/214
2015/0361722 A1 * 12/2015 Chick ..... A01M 31/02 182/113

FOREIGN PATENT DOCUMENTS

DE 202007000406 U1 3/2008
EP 1783322 A1 5/2007
FR 3012510 A1 5/2015
GB 268709 A 4/1927
GB 2279102 A 12/1994
HU 194358 B 1/1988
WO 9918321 A1 4/1999

* cited by examiner

FIG. 3A
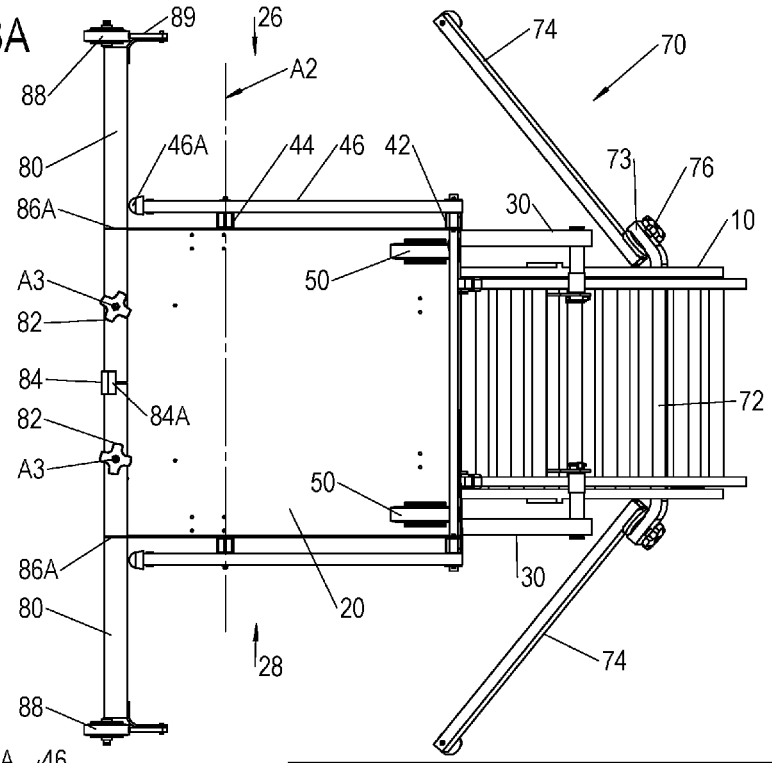
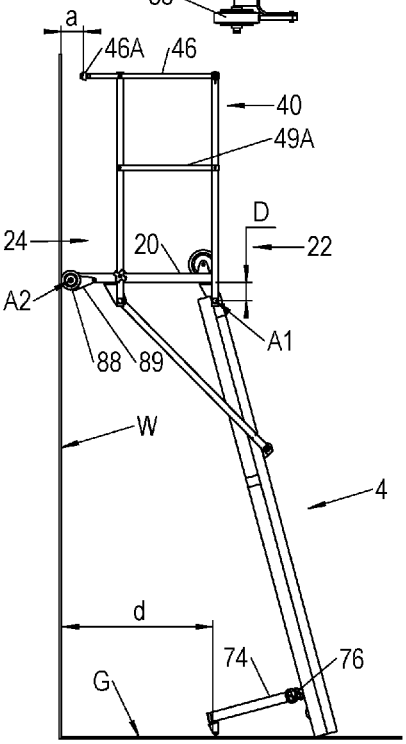
FIG. 3B
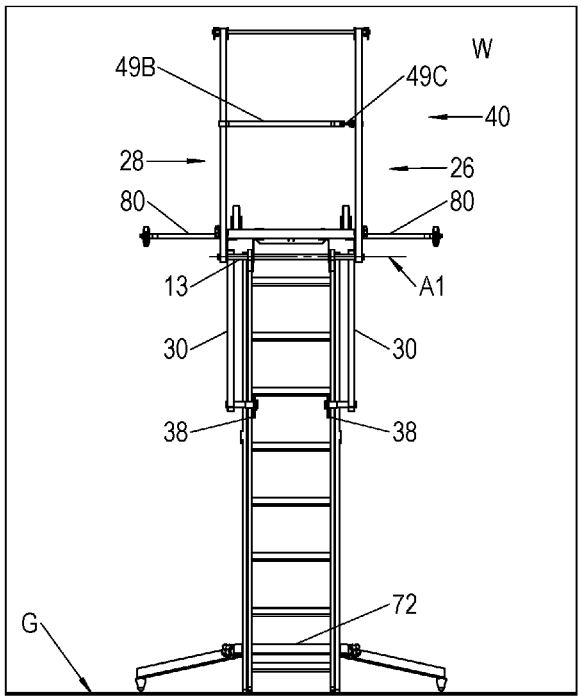
FIG. 3C

PLATFORM LADDER APPARATUS

CROSS-REFERENCES TO RELATED APPLICATIONS

This application claims priority from Swedish Application No. 1651198-2, filed Sep. 7, 2016 incorporated by reference in its entirety.

TECHNICAL FIELD

The present invention generally relates to the field of working platforms, and more specifically to ladders provided with a working platform for use by persons who need to carry out tasks on elevated levels.

BACKGROUND

Work on constructions, houses and the like on elevated levels is often performed by the use of ladders, different types of vertical platform structures, skylifts, and for bigger works by the use of scaffolding arrangements. Each of these has its advantages and drawbacks depending on the type of work, especially depending on the time required for the work.

Ladders are cheap, they can be quickly put in position but often result in serious accidents, why many companies do not allow work being performed by persons standing on a ladder except from a very low level.

Scaffold arrangements and free-standing platform arrangements have a higher degree of stability and safety, but they require time and effort for their mounting and for their adjustment and repositioning during the work.

Single or double sided stepladders with a top platform are more safe than ladders but has often a restricted height and have many of the drawbacks of larger scaffold arrangements.

Skylifts are safe and easy to position and adjust within their operating range when in place, but they are expensive and are relatively time consuming with respect to installation.

The prior art does not offer any solution for arranging a safe and stable work platform for performing work on an elevated level, which can be installed in a short time, which is relatively cheap, which is suitable for less time-consuming works and which may be erected and repositioned by one person only.

EP 1 783 322 discloses an extension ladder provided with a working platform which is mounted on an upper ladder section at a distance below the upper end of the upper ladder section. A pair of stabilizing legs are attached to the lower ladder section. A safety guard arrangement is provided for a user standing upon the platform FR 3 012 510 discloses a similar solution.

US 2012/0168250 discloses a work platform unit mountable to a ladder as a separate unit, said platform unit including a platform mountable to the upper end of a ladder and a safety barrier construction for protecting a person standing upon the platform. The unit is not foldable. A pair of wheels are arranged at the upper side of the safety barrier construction for facilitating the raising and lowering of the ladder with respect to a wall. The wheels axles are telescopically mounted for displacement of the wheels between a stowed position and a slightly extended position.

SUMMARY OF THE INVENTION

It is an object of the invention to provide an enhanced ladder platform apparatus which may be arranged in a simple and quick manner, which is safe in terms of stability, and which can be easily moved between different working positions.

According to an aspect of the inventive concept, there is provided a platform ladder apparatus having a transport position and a use position in which the apparatus is arranged to lean against a wall for performing work at an elevated level, said apparatus comprising:

a ladder having a front side for climbing and a rear side facing the wall in the use position;

a working platform having, seen from the front side of the ladder, a right side, a left side, a proximal side and an opposite distal side, the proximal side of the platform being pivotally connected to the ladder at a platform pivot axis located at an upper end of the ladder, the platform being arranged, in the use position of the apparatus, to extend essentially horizontally out from the ladder with its distal side directed towards the wall, and the platform being arranged, in the transport position of the apparatus, to be pivoted about the platform pivot axis towards the ladder to a stowed position essentially parallel to the ladder; and a right and a left wall support arm for stabilizing the apparatus in the use position in relation to the wall, said wall support arms being connected to the platform for movement between:

- a stowed arm position in which the wall support arms project out from the distal side of the platform thereby preventing use of the apparatus, and
- a stabilizing arm position in which the wall support arms project sideways from the platform in opposite right and left directions, respectively, for stabilizing the apparatus in relation to the wall.

The apparatus of the invention provides an enhanced stability and security compared to known solutions, while at the same time being foldable to a transport position. According to the inventive concept, the wall support arms are arranged and mounted in such a manner that they effectively prevent incorrect and unsafe use of the apparatus. When the wall support arms are in their stowed arm position, and has not yet been moved to their stabilizing arm position, they project out from the distal side of the platform. The arms would typically be projecting out from the distal side of the platform at least partly in a direction perpendicular to the platform pivot axis. Thereby, the wall support arms effectively prevent the platform from being brought into its correct position in relation to the wall. Not until the wall support arms have been moved, preferably manually by the user, to their stabilizing arm position, the apparatus can be correctly raised and leaned against the wall. In other words, the design is such that the stabilizing function obtained by the arms cannot be set aside by mistake by the user since the platform cannot be brought into its position of use in relation to the wall when the arms are in the stowed arm position. The overall design is such that the user is forced to "activate" the stability function of the arms if the apparatus is to be used.

In a preferred embodiment, the wall support arms are rotatably connected to the platform at the distal side thereof for rotational movement in a plane parallel to the platform between said stowed arm position and said stabilizing arm position. Preferably, the rotatable wall support arms are prevented from rotational movement out of this plane parallel to the platform.

The length of the wall support arms may be substantial. As an example, the length of each wall support arm may be similar to or greater than the width of the platform. Another example is choosing a distance between the two distal support points of the support arms to be at least twice the width of the platform.

In general, the following stability aspects may be considered when designing the apparatus: When viewed from above and in the position of use, the apparatus with its applied load (the user and equipment) will have a centre of gravity. If a vertical line passing through the centre of gravity lies in a region between the right and left distal contact or support points of the right and left support arm and the ground contact or ground support points of the apparatus, respectively, the apparatus will be statically stable. If the person on the platform should be leaning over the right or left platform side to such an extent that said vertical line through the shifted centre of gravity should fall outside said region between the points of contact, the apparatus may become instable and fall over. Even if the vertical line through the centre of gravity should be located inside said region but very close to the border of the region, the apparatus may fall over if subjected to only smaller lateral forces. Lateral forces in the form of dynamic lateral forces may occur if the person is moving on the platform. In designing the apparatus it is desired to minimize these risks. This may be accomplished by using wall support arms of a sufficient length, such that the distal contact points of the arms define a region being wide enough to ensure that the vertical line through the centre of gravity is kept within this region and preferably within this region at a safety distance from the borders of the region.

The apparatus according to the invention has the advantage that it may be arranged and adjusted in a quick and easy manner and that it may be folded together to its transport position in a likewise quick and easy manner.

The apparatus according to the invention has especially the advantage that the stabilizing features are designed in such a manner that they cannot be set aside by the user. The apparatus can only be used when the stabilizing features are properly used.

The apparatus according to the invention may be especially useful for types of work which are not substantially time consuming.

Since the platform is pivotally mounted at the upper end of the ladder, the width of the platform is not restricted by the ladder rails compared to prior-art solutions in which the upper parts of the ladder rails extend beyond and over the platform, thereby limiting the width of the platform to the width of the ladder and the user is essentially standing "inside" the ladder.

Preferred embodiments of the design of the wall support arms are set out in the dependent claims. Especially, the design is preferably such that the wall support arms cannot be detached from the platform by the user.

In the stowed arm position, the wall support arms project out from the distal side of the platform thereby preventing use of the apparatus. In some embodiments, the wall support arms may project essentially along a direction perpendicular to the platform pivot axis in the stowed arm position. In other embodiments, the wall support arms may project out from the distal side of the platform at some minor angle in relation to the fully perpendicular direction.

It may also be preferred that the design is such that the only support points of the apparatus against the wall are formed by the wall support arms, including elements such as wheels attached thereto. In one embodiment, the only support points against the walls may be provided at the outer ends of the wall support arms, for instance by wheels or rollers as described below. Other embodiments are also possible. In some embodiments, also the edge of the platform facing the wall may have wall contact. This may on the one hand prevent or limit resilient bending of the wall support arms, but may on the other hand have the drawback that the platform contacting the wall may hinder the raising and lowering of the apparatus. In some embodiments, the apparatus may comprise one or more additional support points and/or support wheels/rollers between the support points at the distal ends of the arms. Such additional support points may be arranged at a slight distance from the wall when the apparatus is unloaded, in order to facilitate raising and lowering of the apparatus. Such additional support points may comprise one single additional central drum or wheel at the platform edge. However, although one or more additional wall support points may be added, from a stability point of view regarding the risk of the apparatus falling over it is the positions of the outer wall contacting ends of the arms which are of importance. Additional contact points there between will not reduce the risk of the apparatus falling over.

The apparatus according to the invention is foldable to a transport position. In one embodiment, the ladder may be an extension ladder comprising a lower ladder section and an upper ladder section each having a front side and a rear side, the upper ladder section being slidably arranged on the front side of the lower ladder section. When the ladder is an extension ladder, the proximal side of the platform may advantageously be pivotally connected to the upper ladder section at said platform pivot axis via one or more brackets extending between the platform and the platform pivot axis for creating a distance between the platform and the platform pivot axis which is sufficient to allow the platform, in the transport position of the apparatus, to be folded over the lower ladder section to its transport position such that the lower ladder section in the transport position of the apparatus is located between the rear side of the upper ladder section and the folded platform. This solution provides a foldable platform ladder apparatus which may have very compact dimensions in its folded and retracted transport position.

In one embodiment, the apparatus may further comprise a user safety railing which in the use position of the apparatus is arranged above the working platform for forming protection for a user standing upon the platform, said safety railing comprising right and left proximal posts arranged at the proximal side of the platform, right and left distal posts arranged further towards the distal side of the platform, and guard rails extending between the posts, said safety railing being structured and arranged to be folded into a stowed position in the transport position of the apparatus. In this embodiment, the apparatus thus comprises a fully foldable platform assembly including the platform and the safety railing. The user does not have to mount and secure any separate components to a separate ladder. All the features (platform, stabilizing wall support arms and safety railing) are integral parts of the apparatus and are directly ready to use when the apparatus is erected from its transport position.

In an especially advantageous embodiment of the apparatus, including a safety railing as described above, each one of the proximal posts may have an upper part which is located above the platform and a lower part which is located under the platform and which is pivotally connected below the platform for pivotal movement about the platform pivot axis, wherein the user safety railing comprises a load transferring rail extending between the upper parts of the right proximal post and the left proximal post. As will be described below, this design has the advantage of providing a very stable safety railing with respect to side loads. The proximal posts will act as levers and the platform may act as a lever fulcrum.

Terminology

The term "platform ladder apparatus" as used herein is to be interpreted as an apparatus comprising at least a ladder and a working platform attached to the ladder. The apparatus according to the invention may typically be an apparatus which is always assembled, i.e. not an apparatus in which the user for each use have to attach or detach main components. The apparatus according to the invention may advantageously be designed as a ready-to-use apparatus which may be unfolded and extracted directly from its transport position to its use position.

The term "extension ladder" as used herein is to be interpreted as a ladder divided into two or more lengths or portions which can be slid together for storage or slid apart with an overlap maintained to expand the length of the ladder.

The terms "climbing side" and "rear side" of the ladder refer to the opposite sides of the ladder where the rear side is facing the wall in the use position of the apparatus. The terms "right side", "left side", "proximal side" and "distal side" of the working platform refer to the sides or directions of the platform when viewing the platform from the ladder in the use position of the apparatus. Thus, the proximal side of the platform will be the side closest to a person standing on top of the ladder, and the distal side will be the side of the platform which is directed towards the wall in the use position. These terms are intended to cover also curved configurations or similar where the shape of the platform does not necessarily present four distinct straight sides.

The term "ladder" as used herein is to be interpreted as comprising ladders with rungs or steps having a relatively small depth, such as rod-like steps, as well as ladders with steps having a larger depth comparable to steps of a staircase. As an example, according to certain regulations, ladders having a height over two meters must be provided with steps having a certain depth, such as at least 50 mm.

The term "wall support arm" as used herein is to be interpreted in a wide sense and comprise also less arm-like moveable support members providing the aimed-at support points on either side of the platform in the use position of the apparatus.

The terms "up", "down", "upper", "lower", "vertical" and "horizontal" refer to positions and directions of the different parts when the apparatus is in its use position.

The platform ladder apparatus has a transport position and a use position. The expression "a use position" should be interpreted to cover also embodiments having multiple use positions, especially multiple use positions with different ladder heights.

BRIEF DESCRIPTION OF THE DRAWINGS

The inventive concept, some non-limiting embodiments and further advantages of the inventive concept will now be further described with reference to the drawings in which:

FIGS. 3A-3C are a top view, a side view and a front view of the apparatus in FIG. 1 in its use position.

DETAILED DESCRIPTION OF THE PREFERRED EMBODIMENTS

Figure 1:
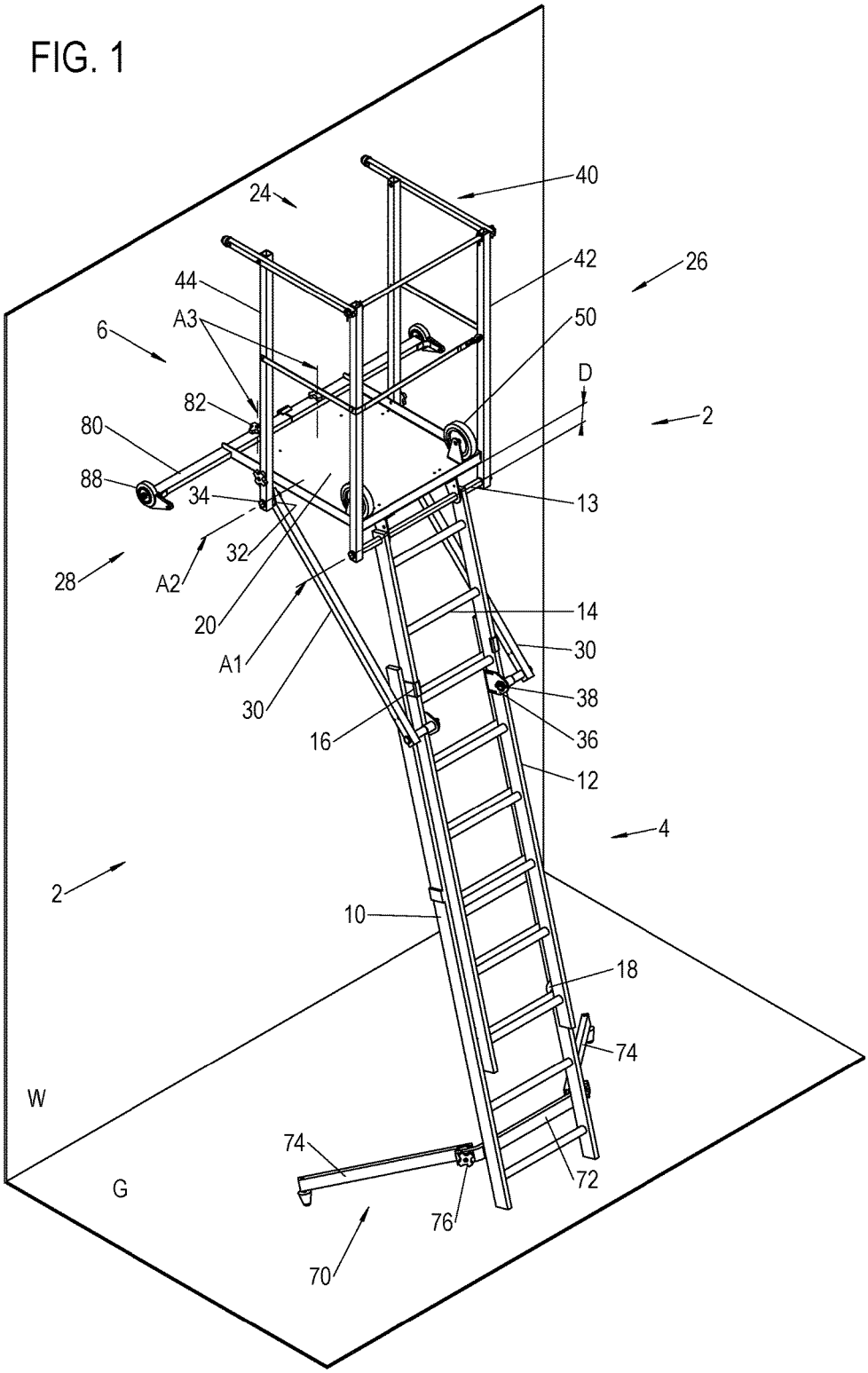
FIG. 1 shows a first embodiment of a platform ladder apparatus according to the invention, showing the apparatus in its use position.

FIG. 1 illustrates a platform ladder apparatus 2 according to a first embodiment of the present invention, comprising a ladder 4 and a foldable platform assembly 6. The platform assembly 6, which includes at least a working platform 20 and a safety railing 40 arranged at the perimeter of the platform, is pivotally connected to an upper end of the ladder 4 as will be described in detail below. The apparatus 2 is shown in it its use position in FIGS. 1 to 3, in which the foldable platform assembly 6 is shown it its unfolded, essentially horizontal use position, arranged at an upper end of the ladder 4. The apparatus 2 is shown in its transport position in FIG. 6 and in a partly folded position in FIG. 4.

As indicated in FIG. 1, the platform ladder apparatus 2 may optionally also comprise transport wheels 50 and a foldable ground support assembly 70.

The apparatus would normally be manufactured mainly from alumina. However, other materials such as plastic or wood are also conceivable.

The ladder 4 may be a telescopic ladder (also termed extension ladder) as illustrated in FIG. 1 comprising a lower ladder section 10 and an upper extractable ladder section 12 (fly section), each ladder section 10, 12 comprising a number or rungs or steps 14 extending between a pair of rails. As known in the art, the ladder sections 10, 12 may be slidably connected to each other by external guide brackets 16, such that the ladder sections 10, 12 can be slid together for transport and storage or slid apart with an overlap to expand the length of the ladder 4 in the use position of the apparatus 2. The ladder sections 10, 12 may be held or locked in their expanded position in different ways as known in the art, such as by hooks 18 and/or lock assemblies. The ladder 4 may optionally be provided with pulley-rope means or the like (not shown) to be operated by a user for performing the ladder extraction/retraction. As an alternative, the ladder 4 may also be a straight ladder built in one section.

In FIGS. 1-3, the apparatus 2 is shown in its use position standing on a ground G and leaning by an angle against a wall W or a surface, with a front or climbing side of the ladder 4 facing away from the wall W and a rear side of the ladder 4 facing towards the wall W, as illustrated in FIG. 3B.

Figure 2A:
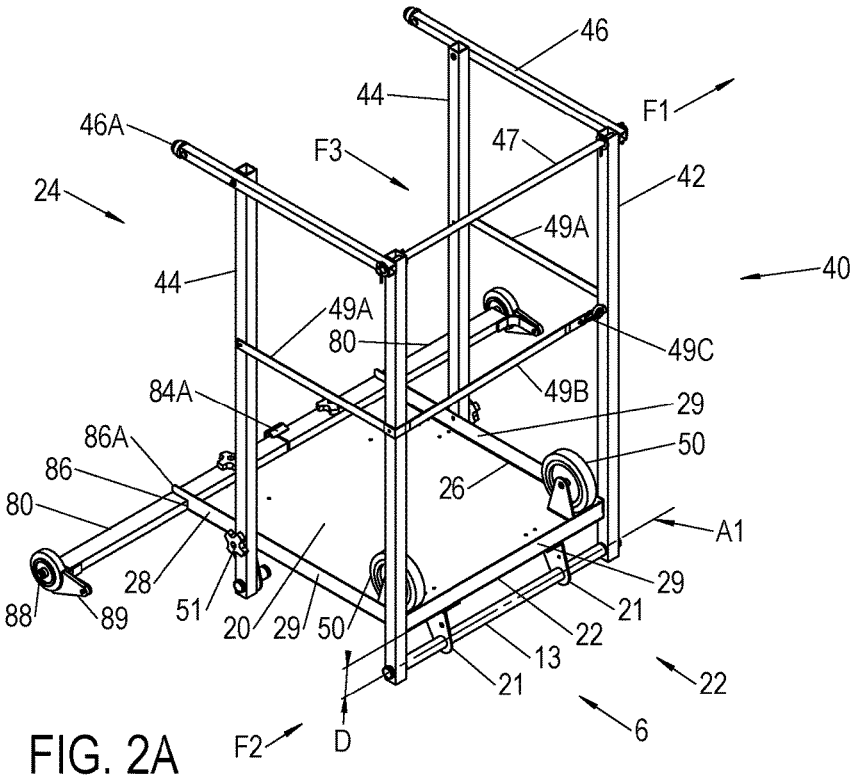
FIGS. 2A-2B are enlarged perspective views of a platform assembly of the apparatus in FIG. 1.
Figure 2B:
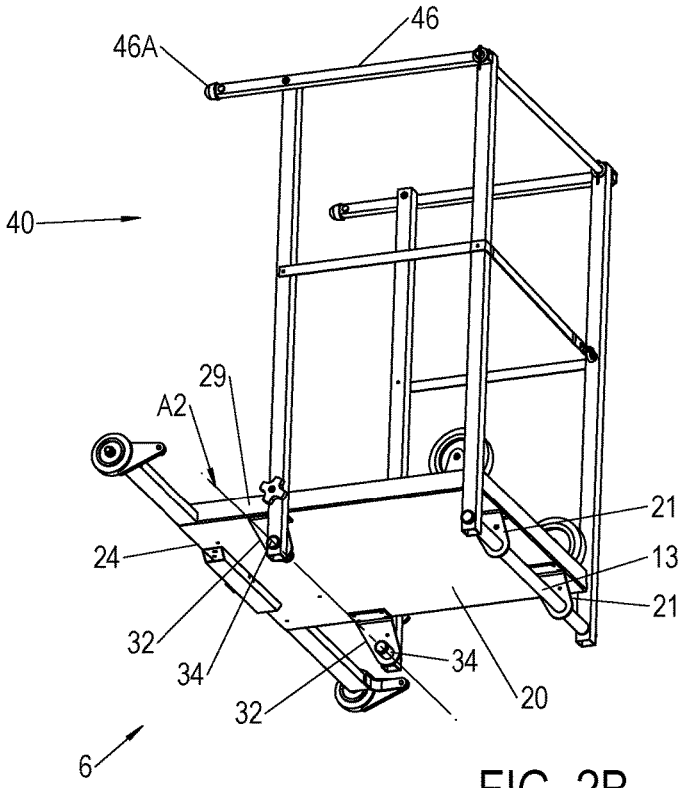

As shown in enlarged scale in FIGS. 2A and 2B, the platform assembly 6 comprises a working platform 20 defining a floor for a user working on an elevated level and safety railing 40 providing a safety barrier for the user standing or working upon the platform 20. In the use position of the apparatus 2, the platform 20 would normally be essentially horizontal although a minor angle also would be possible.

The working platform 20 may have a rectangular shape as in the present embodiment, although other shapes are possible, such as square shape, partly rounded shapes and all rounded shapes. The platform 20 presents, when viewed by a person standing on the climbing side of the ladder 4 in the use position of the apparatus 2 and facing the wall, a proximal side 22, an opposite distal side 24 and right and left sides 26, 28.

As illustrated in this embodiment, the platform 20 may be provided with a upright safety border 29 along its proximal side 22 and along its right and left sides 26, 28.

The platform 20 is pivotally connected to the upper end of the ladder 4, in this embodiment the upper end of the upper ladder section 10, for pivotal movement in relation to the ladder 4 about a platform pivot axis A1 which is parallel to the rungs 14. As illustrated in this embodiment, this pivotally connection may be implemented by a tube 13, a solid axle or solid tube arranged at the proximal side 22 of the platform 20.

Figure 4A:
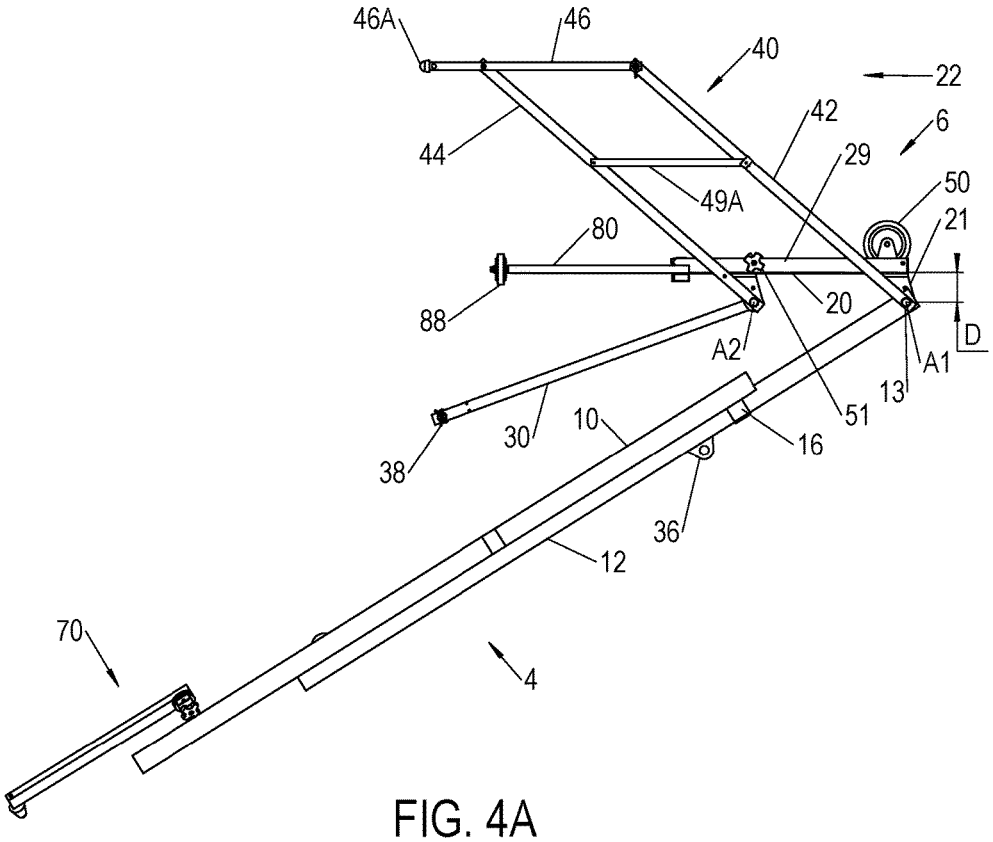
FIGS. 4A-4B show the apparatus in FIG. 1 with the platform assembly in a partly folded position.

In a preferred embodiment, the platform pivot axis A1 is located at a distance D from the bottom side of the platform 20, as indicated for instance in FIGS. 2A and 4A. This distance D may serve dual purposes or advantages as will be explained below. The distance D may be implemented by one or more pivot brackets 21 arranged on the bottom side of the platform 20 at the proximal side 22 thereof. In the embodiment shown, the tube 13 extends through openings in a pair of such pivot brackets 21 while the upper ends of the pair of rails of the upper ladder section 12 are pivotally connected to the tube 13 on the outer right and left sides of the pivot brackets 21.

A first advantage obtained by arranging the platform pivot axis A1 at the distance D from the platform 20 relates to the operation of folding the apparatus 2 into its transport position. As best shown in FIG. 4A (partly folded position) and in FIGS. 6C and 6D (folded position), the distance D is sufficient to allow the platform 20 to be folded over the lower ladder section 10 of the retracted ladder 4 in the stowed transport position of the apparatus 2, such that the lower ladder section 10 in the transport position is located between the rear side of the upper ladder section 12 and the folded platform 20, resulting in very compact dimensions of the apparatus in its transport position.

A second advantage obtained by arranging the pivot axis at a distance D from the platform 20 relates to the stability of the protective guard or safety railing 40 as will be described in detail below.

The apparatus 2 may further comprise a pair of struts 30 for maintaining the platform 20 in the desired angle (horizontally) in relation to the ladder 4 in the use position of the apparatus 2. As illustrated in FIG. 1, each strut 30 has a lower end connected to the ladder 4 and an upper end connected to the platform 20. These connections may be pivotally connections.

Figure 4B:
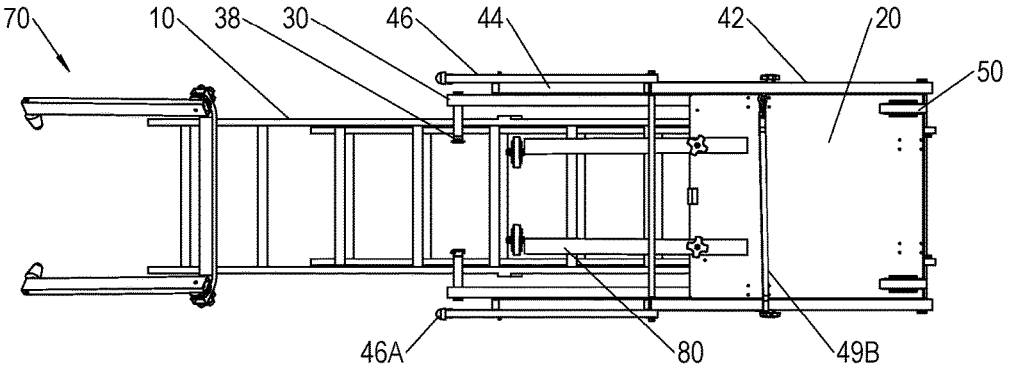

In the illustrated embodiment, the upper connection of the struts 30 to the platform 20 is implemented by a pair of downwardly projecting brackets 32 (see FIG. 2B) defining a second pivot axis A2 at a distance below the platform 20. The upper end of each strut 30 is pivotally connected to an associated pivot bracket 32 by a pivot member 34. The lower pivotally connection of the struts 30 to the ladder 4 is implemented by a pair of brackets 36 attached to the upper ladder section 12. In the illustrated embodiment, this lower connection of the struts 30 to the ladder 4 is releasable connection, such that the user may connect the struts to the ladder in the use position and disconnect the struts 30 from the ladder 4 for folding the apparatus into the transport position. The disconnected struts 30 are illustrated in FIGS. 4A and 4B (partly folded position) and in FIGS. 6A-6E (transport position). The releasable connection of the struts 30 to the brackets 36 may be implemented by removable pins 38 or by some other means.

The safety railing 40 of the foldable platform assembly 6 according to the embodiment shown in FIG. 1 will now be described with reference to the use position of the apparatus 2. The safety railing 40 may be arranged along the perimeter of the platform 20 and comprises a pair of proximal posts 42 which may be arranged at the proximal right and left corners of the platform 20 and a pair of distal posts 44 which may be arranged as illustrated further towards the distal side 24 of the platform 20 at the right and left platform sides, respectively. The posts 42, 44 would normally be essentially vertical in the use position. A lower end of each proximal post 42 is pivotally connected to the tube 13 at the distance D from the platform 20, for pivotal movement about the proximal pivot axis A1. Similarly, a lower end of each distal post 44 is pivotally connected to an associated one of the pivot members 34 held by the brackets 32 for pivotal movement about the distal pivot axis A2.

In some embodiments, the distal posts 44 may be arranged at the distal corners of the platform 20. However, it may be preferred to arrange the distal posts 44 at a certain horizontal distance from the distal corners of the platform 20 as illustrated in FIGS. 2A and 2B. This will create an advantageous work space between the posts 44 and the wall in the use position. This arrangement may also have the advantage of reducing the overall weight of the apparatus since the struts 30 will be shorter and the brackets 32 will be located more towards the centre of the platform side edges, thereby allowing a less strong (less heavy) platform construction.

In addition, the safety railing 40 comprises a pair of upper side rails 46 which pivotally interconnect the two right posts 42, 44 and the two left posts 42, 44, respectively, at the upper ends of the posts. In the illustrated embodiment, an upper proximal rail 47, such as a tube or the like, interconnects the upper ends of the proximal posts 42.

According to the illustrated embodiment, each side rail 46 may extend distally beyond the distal posts 44 (FIGS. 2A, 2B and 3B) and may be provided with a revetment 46A at its proximal end facing the wall W. The purpose of the revetments 46A will become apparent from the following. The revetments 46A may optionally be designed as small wheels or rollers.

In the illustrated embodiment, the safety railing 40 further comprises, at an intermediary level between the upper ends of the posts 42, 44 and the platform 20, left and right intermediate rails 49A and an intermediate proximal rail 49B. In order to allow the user to access to the platform 20, the intermediate proximal rail 49B can be opened/removed, e.g. by a hook 49C or the like at one end of the rail 49B.

It will be appreciated that each one of the right-hand side and the left-hand side of the safety railing 40 is constructed as a foldable parallelogram, as best shown in the partly folded position of the railing 40 in FIG. 4A, in which the struts 30 are disconnected from the ladder 4 and the posts 42, 44 are pivoted about the pivot axis A1 and A2, respectively.

In order to secure the railing 40 in its use position and prevent such folding movement as shown in FIGS. 4A and 4B, the distal posts 44 may be releasably secured to the right and left sides, respectively, of the platform 20 by means of screws and threaded knobs 51 or by other means. In the illustrated embodiment, the screws and the knobs 51 engage the right and left platform borders 29. As an alternative, the screw-and-knob fixing may be arranged at the proximal posts 42 instead, or at both the distal and the proximal posts.

As mentioned above, the distance D between the proximal pivot axis A1 and the platform 20 has dual advantages: As described above, the first advantage of arranging the distance D is related to the advantage of the platform 20 being foldable over the lower ladder section 10 in the transport position of the apparatus 2 when the two ladder sections 10,12 overlap. The second advantage of arranging the distance D is related to the stability of the railing 40, especially the stability in the right-left direction, in the upright use position of the safety railing 40 as shown in FIG. 1.

If a user standing upon the platform 20 leans against for instance the right side of the safety railing 40, e.g. against the right-hand upper side rail 46, this will create a load or force on the right proximal post 42, as indicated by an arrow F1 as indicated in FIG. 2A. This force F1 will be transferred from the right proximal post 42 via the tube 47 and/or the member 49B to the left proximal post 42. Due to the manner in which the proximal posts 42 are mounted with its points of connection to the tube 13 located at a distance D below the platform 20, the left proximal post 42 will in this situation act as a lever and the platform 20 will act as the fulcrum (pivot point) for this lever. Accordingly, since the lower end of the lever (left post 42) is connected to the pivot tube 13 at the distance D from the fulcrum 20, the force F1 will effectively be counter-acted by a force F2 as indicated in FIG. 2A, resulting in a very stable safety railing construction. The similar effect applies obviously in the other direction if a load is applied on the left side of the railing 40. The effect is that the railing 40 is effectively stabilized compared to a design where the lower ends of the posts 42 would have been fixed only in level with the platform.

Forces acting on the distal posts 44 connected to the distal brackets 32 will in the same manner be counter-acted by the distal posts 44 acting as levers and forces from the pivot pins 34 acting on the lower ends of the distal posts 44.

In the illustrated embodiment, the tube 13 and the first pivot axis serves dual purposes. The tube 13 is used both for the pivotal connection of the platform 20 to the ladder and for connecting to the lower ends of the proximal posts 42 for obtaining the lever action. This provides a compact and cheap solution for obtaining both effects. In alternative embodiments, a separate axis may be provided for each one of the two functions.

It may also be noted that any user load acting on the upper proximal railing 47, as indicated by an arrow F3 in FIG. 2A, will be at least partly transferred to the ladder 4 via the struts 30.

To summarize, this design of the railing 40 and the lever function of the posts 42, 44 has the advantage that the railing structure is foldable as well as very stable in the use position, a combination which is generally difficult to obtain in foldable structures.

In order to enhance the stability of the apparatus 2 in its use position, the platform assembly 6 is further provided with a pair of stabilizing wall support arms or support members 80, including a right arm/member and a left arm/member. These elements will be referred to as "arms" in the following. Each arm 80 may be rotatably connected to the platform 20 at the distal platform side 24 for rotational movement in a plane parallel to the platform 20. The longer the arms, the better stability may be obtained as described above. Preferably, the outer end of each arm—or any member attached to the outer arm end—will have contact with the wall in the use position of the apparatus. In some embodiments, these two contact points will be the only wall contact points of the apparatus. In other embodiments, there may be one or more further points or areas of wall contact, such as at the platform 20. Such further contact points may be points of direct contact or points of indirect contact via wheels or rollers. As an example, the distance between the two distal wall contact points of the arms 80 may be about 1 500 mm for a platform width being about 680 mm, giving a ratio of about 2.2. According to one aspect, the distance between the distal points of contact should be at least twice the platform width. This ratio may be increased for increased stability and/or for making it easier to use the apparatus at wide windows.

Specifically, the wall support arms 80 may be movable, preferably manually by a user, between:

- a stowed arm position (see FIGS. 5A and 5B) in which the wall support arms 80 project out from the distal side 24 of the platform 20, typically at least partially or essentially completely along a proximal-distal direction perpendicular to the first pivot axis A1 thereby preventing use of the apparatus as a result of the arms 80 preventing the platform 20 from be positioned correctly in relation to the wall W, and
- a stabilizing arm position (see FIGS. 1 and 3A) in which the wall support arms 80 project sideways from the platform 20 in opposite right and left directions, respectively, for stabilizing the apparatus 2 in relation to the wall W.

In the illustrated embodiment, the wall support arms 80 are rotatably connected to the platform 20 at two rotational axes A3, extending at right angles to the platform 20 at the distal side 24 thereof and located at a distance from the right and left platform sides 26, 28. Each rotational axis A3 is located between an outer end and an inner end of the associated arm 80, thereby dividing each arm 80 into an outer arm portion and an inner arm portion. In the illustrated embodiment, each rotational axis A3 is implemented by a threaded pin, and for securing the arms 80 in their respective positions a handle or a knob 82 is threaded onto each pin in manner that the knob 82 may not be removed and lost, for instance by providing a deformation of the threading or by other means. Thus, the apparatus is preferably designed such that the wall supporting arms 80 cannot be detached and lost by the user.

In the preferred embodiment, the wall support arms 80 are located in level with the platform 20. More specifically, in the illustrated embodiment they are located on top of the platform 20, but it may also be possible to locate the arms 80 in the plane of the platform 20 or just below the platform.

According to the illustrated embodiment, the apparatus 2 may optionally further comprise arm engaging means 84, 86 which are structured and arranged to engage the wall support arms 80 in their stabilizing arm position to restrict any further movement of the arms 80 beyond the stabilizing arm position, when the arms 80 are being moved from their stowed arm position (FIG. 5B) in the transport position of the apparatus into their stabilizing arm position (FIG. 3A) in the use position of the apparatus. These arm engaging means 84, 86 comprise, in the illustrated embodiment, a central rotational stop member 84 which is arranged centrally on the platform 20 at the distal side 24 thereof and engages the inner arm portions, i.e. the ends of the inner arm portions, in the stabilizing arm position in FIG. 3A. This central rotational stop member 84 not only defines a rotational stop position for the arms 80, it also has an upper proximally extending extension 84A, which in the stabilizing arm position extends over each arm 80 as shown in FIGS. 2A and 3A in order to prevent vertical movement of the arms 80 in relation to the platform 20 in the stabilizing arm position.

The arm engaging means 84, 86 further comprise a pair of right and left rotational stop recesses 86 formed in the distal ends of the right and left platform borders 29, as best illustrated in FIG. 2A. These stop recesses 86 not only define a rotational stop position for the arms 80. An upper extension 86A of each platform side border 29 extends over the recess 86 and over the associated arm 80 received in the recess 86 in order to prevent vertical movement of the arms 80 in the stabilizing position.

It will be appreciated that due to the design of the arm engaging means 84, 86 preventing vertical movement of the wall support arms 80 in relation to the platform 20 in the stabilizing arm position, no vertical forces have to be taken by the screws an and knobs 82 at the arm pivot axis A3.

The design, connection and movability of the stabilizing wall support arms 80 provide the apparatus 2 with a safety and stabilization feature which cannot be set aside by the user due to oversight or lost components. The arms 80 cannot be removed and lost, so the user does not have to locate and mount the arms when erecting the apparatus 2. More important, the design is such that the arms 80 effectively prevent any use of the apparatus unless they have been brought to their stabilizing arm position. In other words, the arms 80 have a dual function: they give stability in the use position of the apparatus 2 and they prevent use of the apparatus 2 if the stability function is not activated.

Also, the stabilizing arm position is maintained by gravity during use, which in combination with the arm engaging means 84, 86 effectively holds the arms 80 in correct aligned position when the user is standing upon the platform 20. The knobs 82 provide an additional security and will especially hold the arms 80 in position during the initial unfolding and erection of the apparatus 2.

In the illustrated embodiment, each arm 80 is provided with a wheel or roller 88 at an outer end of the arm 80 for engaging the wall W in the use position of the apparatus. In a preferred embodiment, the wheels 88 may be rotatable in one direction only, such that the wheels 88 may rotate in a first direction against the wall when the apparatus is raised into its use position against the wall W but prevented (or at least braked) from rotating in an opposite second direction in order to prevent unintentional lowering of the platform 20. This one-way function may be a complete rotational blocking function or just a brake function. Reference numeral 89 indicate means for accomplishing this one-way function of the wheels 88.

In other embodiments of the apparatus, the arms 80 may be provided with other contact means instead of wheels 88 or in addition to the wheels 88.

In some embodiments, each arm 80 may have an individually adjustable length, for instance by using telescopic arms, in order to suitably adjust the point of contacts of the wheels 88 against the wall W.

As mentioned above, the illustrated embodiment of the apparatus also comprises a ground support assembly 70. In a simpler design of the apparatus, the ground support assembly 70 may not be necessary.

In the embodiment illustrated in FIG. 1, the ground support assembly 70 comprises (see FIG. 3A) a horizontal central beam 72 fixedly connected to the rear side of a lower part of the lower ladder section 10. The ends 73 of the central beam 72 extend beyond the rails of the lower ladder section 10 and are angled in a plane perpendicular to the ladder 4 towards the wall W. A pair of pivotal ground support legs 74 are pivotally connected to the angled ends of the central beam 72 by means of screws and threaded knobs 76. Optionally, embossed washers may be used for this connection whereby the arms 74 are effectively looked in position already for a relatively low torque applied by the knobs 76. As with the connection of the stabilizing arms 80, the threads of the screw engaging the knobs 76 may be deformed in order to prevent removal the ground support legs 74.

Figure 5A:
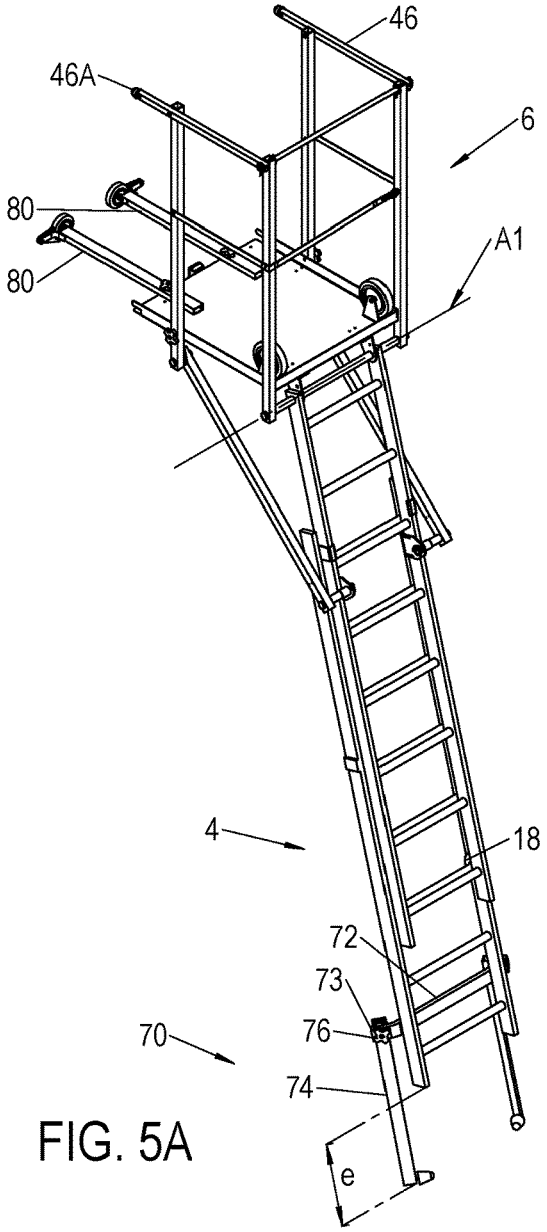
FIGS. 5A-5B show the apparatus in FIG. 1 in an unfolded position illustrating fail-proof stability features of the apparatus.
Figure 5B:
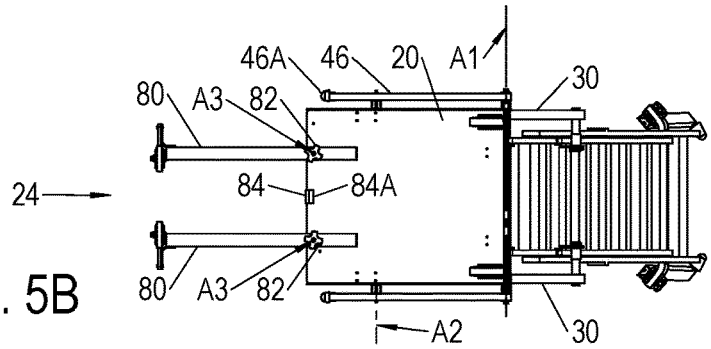

With reference to FIGS. 5A and 5B, similar to the fail-safe design of the wall support arms 80, which are designed such that they prevent correct positioning of the apparatus 2 unless they are brought into their stabilizing arm position, the ground support assembly 70 is also designed such that it prevents a correct positioning of the apparatus 2 unless the stabilizing function of the ground support assembly 70 is activated by pivoting the ground support legs 74 from their transport position (FIGS. 5A and 5B) to their stabilizing position (FIGS. 1 and 3A). As will be seen in FIG. 5A, showing the ground support legs 74 in their transport position extending in the direction of the ladder 4, the ground support legs 74 extend beyond the lower rail ends of the ladder 4 with a distance "e", thereby preventing the ladder 4 from being placed on the ground G unless the user rotates the support legs 76 to their ground stabilizing position as shown in FIG. 1.

It may be preferred that the ground support legs 74 are mounted such that they cannot be rotated upwardly from their stabilizing position in FIGS. 1 and 3A, in order to ensure that the legs protrude beyond the ladder in the transport position.

Figure 6A:
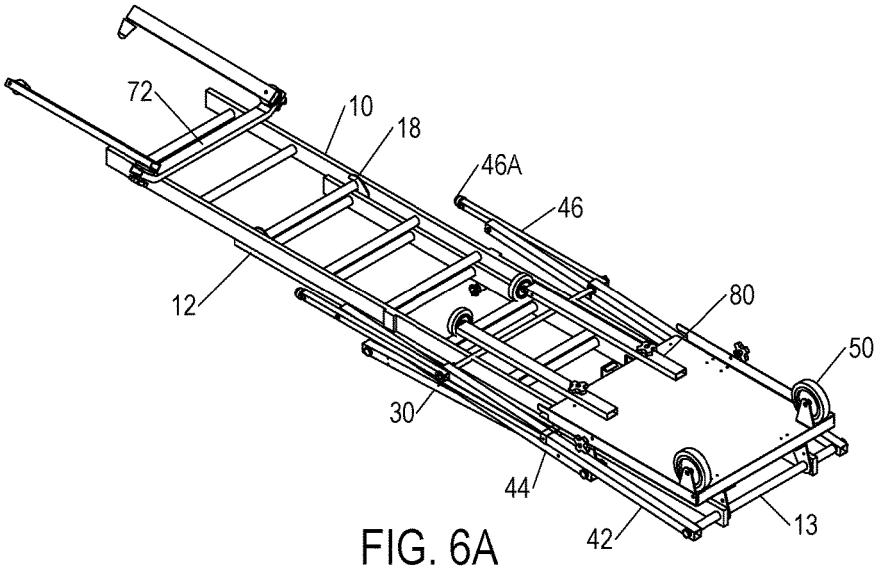
FIGS. 6A-6E show the apparatus in FIG. 1 in its folded transport position.
Figure 6B:
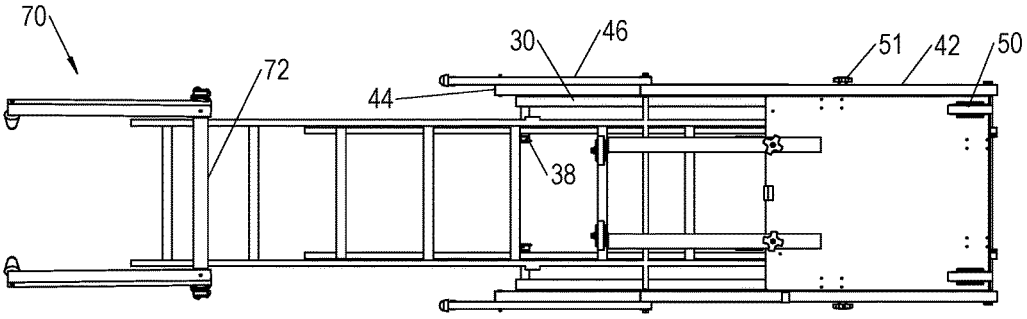
Figure 6C:
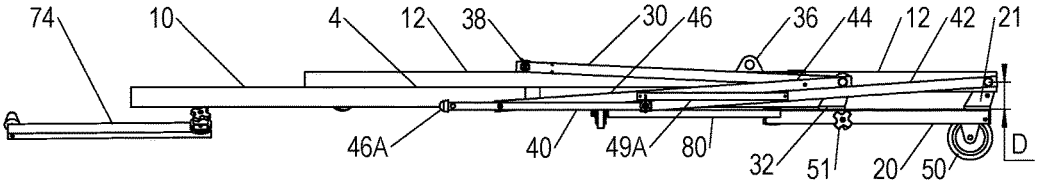
Figure 6D:
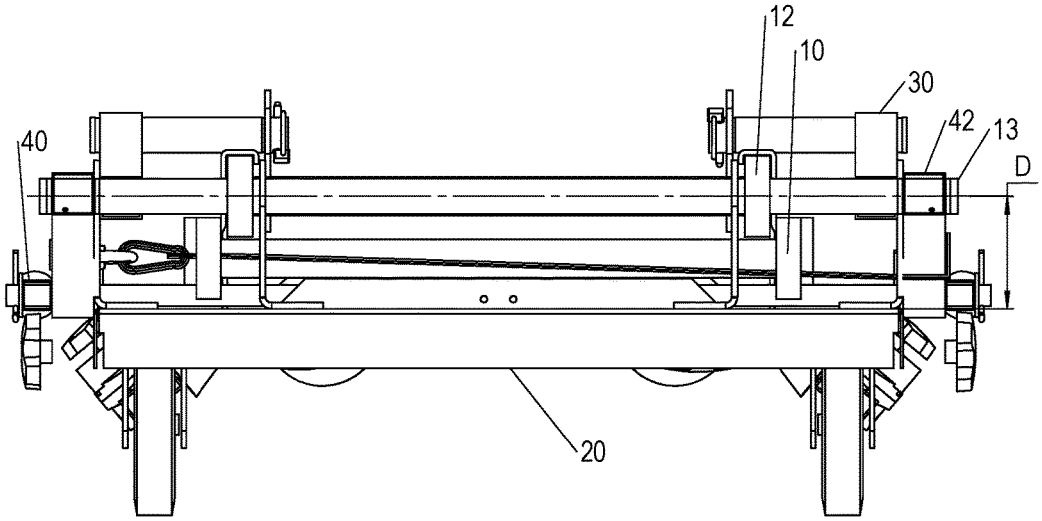
Figure 6E:
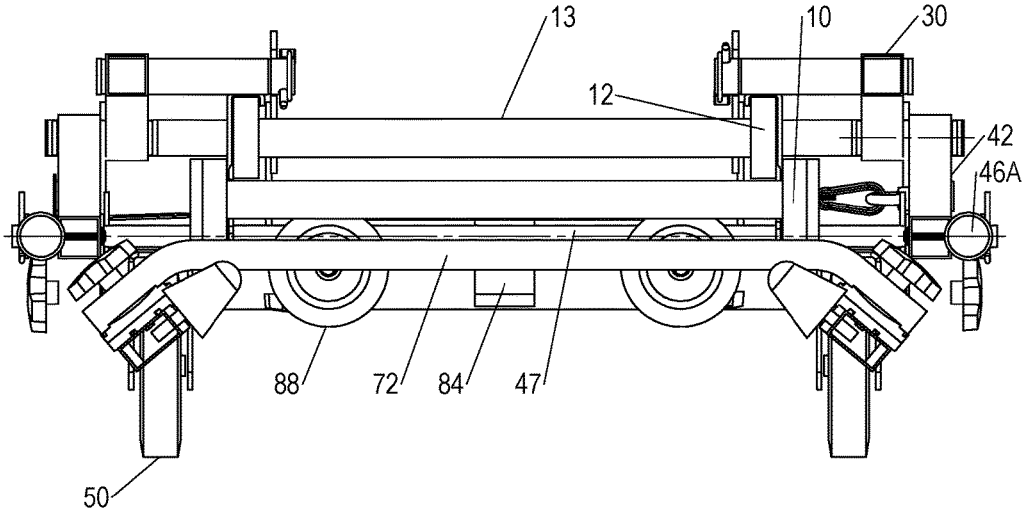

The apparatus 2 as described above is used in the following manner: The apparatus 2 is initially transported in its folded transport position (FIG. 6) to the site where it is to be used. Optionally, the apparatus 2 may be rolled on the transport wheels 50 and placed on the ground as shown in FIG. 6C to E. Next, the ladder 4 is pivoted or folded out from the platform 20 and secured by the struts 30 and pins 38. Thereafter, the ladder 4 is laid down on the ground. The safety railing 40 is fixed in position in relation to the platform 20 by the knobs 51. The configuration of the apparatus 2 is now as illustrated in FIGS. 5A and 5B. In this configuration, the wall support arms 80 are still extending out from the platform 20 in the proximal-distal direction and the ground support legs 74 are still extending beyond (distance "e") the lower end of the ladder 4. Thereby, the user cannot place the apparatus 2 against the ground G and the wall W without first moving the arms 80 and the legs 74 to their stabilizing use positions as shown in FIG. 1.

Thus, the wall support arms 80 will next be rotated to their stabilizing arm position and fixed by the knobs 82, and the ground support legs 74 will be rotated away from their stowed leg position (such that the lower end of the ladder may be put on the ground G).

Next, the apparatus 2 is raised and the wheels 88 of the wall support arms 80 are placed against the wall W for stabilizing the apparatus 2. Thereafter, the position of the platform 20 is adjusted to a suitable work level by extending the upper ladder section 12, while the wheels 88 will be rolling against the wall W. Next, the ladder sections 10, 12 are locked in relation to each other by the hooks 18.

The lower part of the ladder 4 is then adjusted on the ground G such that the platform 20 becomes horizontally. The revetments 46A of the upper side rails 46 will then be at a distance "a" from the wall W as shown in FIG. 3B. The ground support legs 74 are now also adjusted in relation to the ground G and fixed by the knobs 76.

With respect to the vertical stability of the apparatus 2, the positions of the points of contacts and the frictional forces at the points of contacts are essential. If the horizontal distance "d" (see FIG. 3B) between the wall W and the ground support legs 74 is increased, then the frictional forces at the points of contacts must also increase in order to maintain vertical stability. The means 89 for one-way rotation restricts or brakes the wheels 88 from rolling downwards against the wall W, resulting in frictional forces between the wheels 88 and the wall W.

Initially, the downwardly directed force from the platform ladder apparatus 2 is primarily taken by the ladder's 4 point of contact against the ground G, and to a less degree by the points of ground contact of the ground support legs 74. The reason therefore is that the final adjustment of the ground support legs 74 took place while the apparatus 2 was already standing on the ground G and leaning against the wall W.

If for some reason the frictional forces against the wall W and/or the ground G should be insufficient, and a sliding movement should occur at the points of contact, for instance due to dynamic forces acting on the apparatus 2, then the ground support legs 74 will be pressed harder against the ground G with a resulting increase of frictional forces in relation to the ground G, which will counteract the sliding movement of the apparatus 2. If the apparatus 2 nevertheless should continue its sliding movement, then the distance "a" (see FIG. 3B) will be gradually reduced and the revetments 46A will eventually be brought into contact with the wall W, resulting in additional frictional forces counteracting the sliding movement. If the revetments 46A should be brought into contact with and press against the wall W, a new geometric structure is obtained in which the apparatus is supported against the wall at a higher level. This, in its turn, results in a reduction of the forces which tend to make the apparatus slide.

Figure 7:
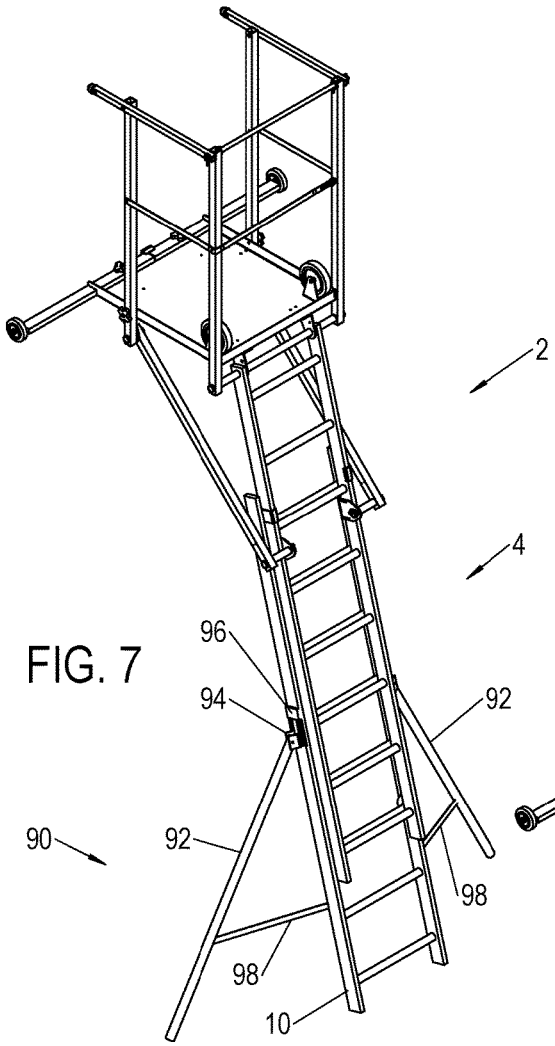
FIG. 7 shows the platform ladder apparatus in FIG. 1 with second alternative design of a ground stabilizing assembly.

FIG. 7 illustrates the apparatus in FIGS. 1 to 6, but with a second embodiment of a ground support assembly 90. In this embodiment, the ground support assembly 90 comprises two relatively longer ground support legs 92 which are pivotally connected to the lower ladder section 10 via brackets 94. The position of the brackets 94 may be adjusted along the ladder section 10 and be fixed by screw means (not shown) in the desired position. The brackets 94 cannot be adjusted beyond stop means 96 in order to prevent the user from setting aside the fail-safe function of the ground support assembly 90. The pivotal movement of the ground support legs 92 is restricted by straps 98 having an adjustable length. As with the assembly 70, the ground support legs 92 extend beyond the lower end of the ladder 4 in their stowed leg position, preventing the user from placing the ladder 4 against the ground G unless the ground support legs 92 have been brought into their stabilizing leg position.

Figure 8:
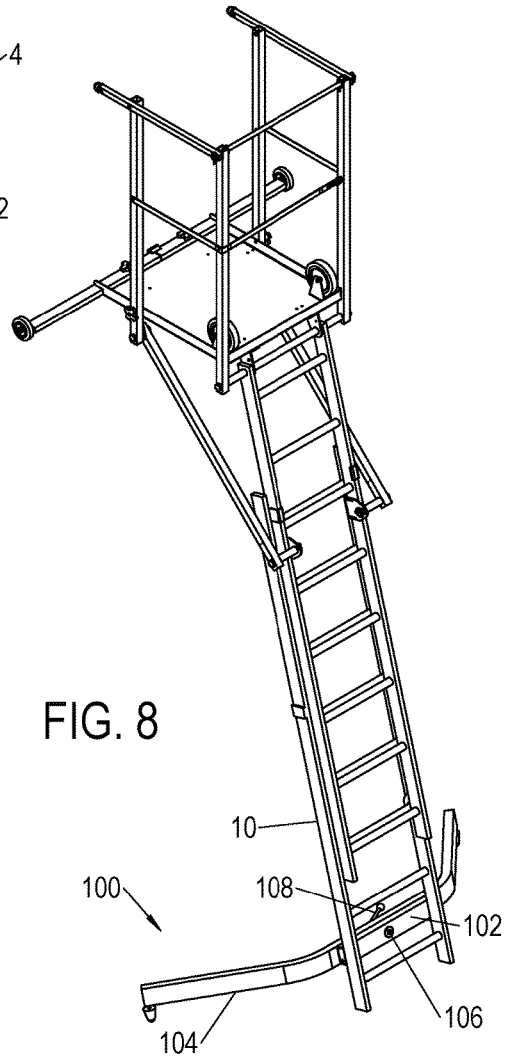
FIG. 8 shows the platform ladder apparatus in FIG. 1 with third alternative design of a ground stabilizing assembly.

FIG. 8 illustrates the apparatus in FIGS. 1 to 6 but with a third embodiment of a ground support assembly 100. In this embodiment, the ground support assembly 100 comprises a horizontal beam 102 fixed to the lower ladder section 10 and a rotatably mounted ground support 104 having a central portion and right and left angled side portions extending to the right and the left beyond the ladder in the stabilizing position. The ground support 104 is pivotally connected to the central beam 102 by means of a screw 106 and a nut provided with a lever 108. The position of the horizontal beam 102 along the ladder may optionally be slightly adjustable in order to allow a fine-tuning of the ground contact points of the ground support 104.

In all embodiments of the ground support assembly, the design is preferably such that it is not possible to remove the ground support assembly from the apparatus.

Figure 9:
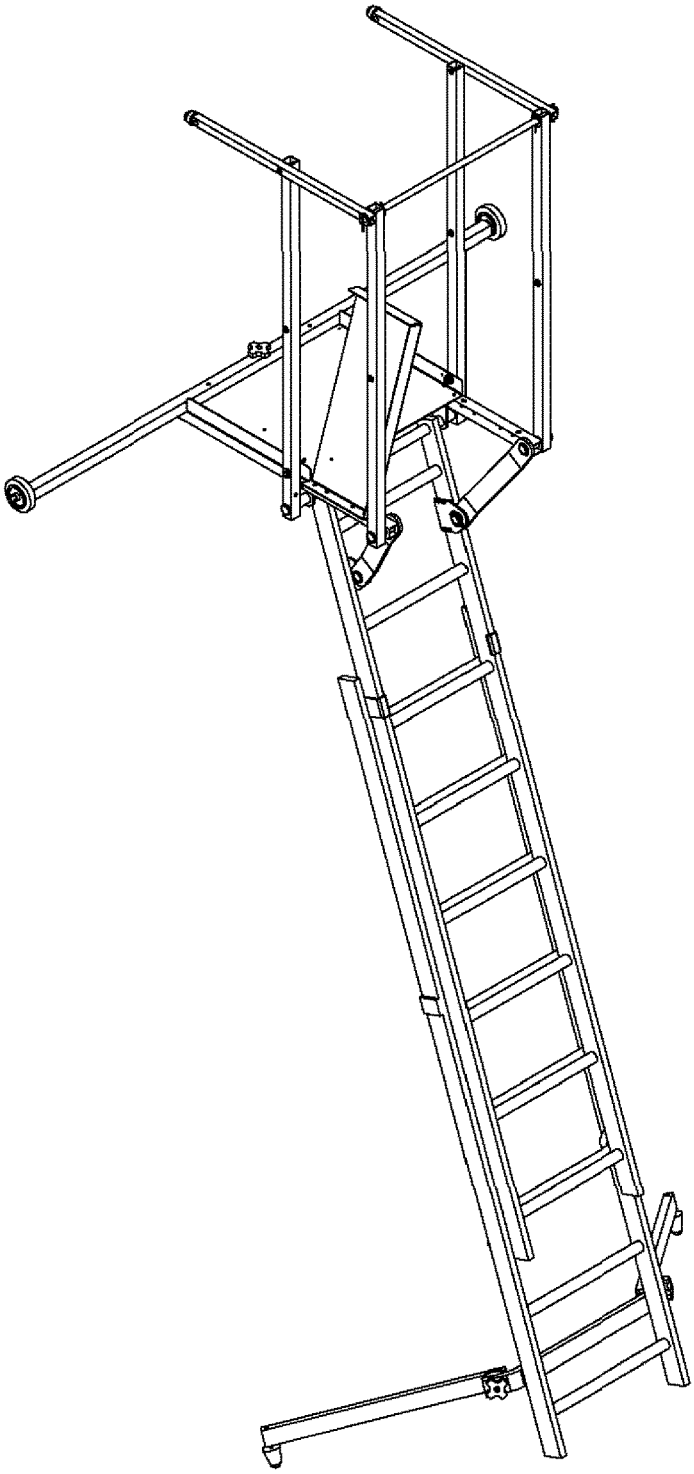
FIG. 9 shows a second embodiment of a platform ladder apparatus according to the invention, showing the apparatus in its use position.

FIG. 9 illustrates a second embodiment of a platform ladder apparatus in its position of use. The second embodiment is in many aspect similar to the first embodiment described above. However, the second embodiment further comprises a pivotable hatch arranged on the proximal side of the platform. FIG. 9 shows the hatch in its raised open position allowing the user to access the platform. In its horizontal closed position (not shown), the hatch and the platform will together form an extended platform. Further, the safety railing is modified in the second embodiment in that the distal posts 44 in the first embodiment are not present and instead a pair of additional vertical posts are arranged on the proximal side of the hatch, said additional vertical posts being connected to horizontal beams extending proximally from the platform sides. Finally, the struts 30 in the first embodiment fixing the platform in relation to the ladder are replaced in the second embodiment with a pair of shorter struts arranged on the front side of the ladder and connected to the lower ends of said additional vertical posts. The struts in the second embodiment will take both compression forces and traction forces depending on the position of the user, whereas the struts 30 in the first embodiment will mainly take compression forces.

I claim:

1. A platform ladder apparatus (2) having a transport position and a use position in which the apparatus is arranged to lean against a wall (W) for performing work at an elevated level, said apparatus (2) comprising:

a ladder (4) having a front side for climbing and a rear side configured to face the wall (W) in the use position;

a working platform (20) having a first planar surface and an opposite second planar surface which are bounded, as seen from the front side of the ladder (4), la a right side, a left side, a proximal edge and a distal edge, the proximal edge of the platform being pivotally connected to the ladder at a platform pivot axis (A1) located at an upper end of the ladder, the platform (20) being arranged, in the use position of the apparatus, to extend essentially horizontally out from the ladder (4) with its distal edge (24) directed towards the wall (W), and the platform (20) being arranged, in the transport position of the apparatus (2), to be pivoted about the platform pivot axis (A) towards the ladder (4) to the transport position essentially parallel to the ladder (4); and a right wall support arm and a left wall support arm (80) for stabilizing the apparatus in the use position in relation to the wall, said wall support arms (80) being rotatably directly connected to the first planar surface of the platform (20) at an associated respective right and left rotational axis (A3) that extends perpendicularly to both the first planar surface and the second planar surface, the wall support arms configured to move about the respective right and left axes between:

a stowed arm position in which the wall support arms (80) project out from the distal edge (24) of the platform (20), and a stabilizing arm position in which the wall support arms (80) project sideways from the platform (20) in opposite right and left directions, respectively, for stabilizing the apparatus (2) in relation to the wall (W);

further comprising arm engaging means (84, 86) attached to the platform and which are structured and arranged to engage the wall support arms (80) in their stabilizing arm position to restrict any rotational movement of the wall support arms (80) beyond the stabilizing arm position, when the wall support arms (80) are being rotated from their stowed arm position into their stabilizing arm position; wherein said wall support arms are rotatably connected to the platform at the distal edge thereof for rotational movement in a plane parallel to the platform between said stowed arm position and said stabilizing arm position;

wherein the rotational axis (A3) of each wall support arm (80) is located between an outer end and an inner end of each wall support arm (80), thereby dividing each wall support arm (80) into an outer arm portion and an inner arm portion, and wherein said arm engaging means (84, 86) comprise:

a right-side stop means and a left-side stop means (86) attached to the platform, wherein the left-side stop means and the right-side stop means engage the outer arm portion of the right wall support arm and left wall support arm, respectively, in the stabilizing arm position, and a single central rotational stop member (84) attached to the platform and being located at a point directly half way between the right rotational axis and the left rotational axis, the single central rotational stop member engaging the inner arm portions of the right and left wall support arms (80) in the stabilizing arm position; and, wherein the left and right wall support arms are configured to move into engagement with the right-side stop means, the left-side stop means, and the central stop member when moved into the stabilizing arm position from the stowed arm position to prevent further rotation of the left and right wall support arms.

2. The apparatus according to claim 1, wherein the wall support arms (80), when in said stowed arm position, project out from the distal edge of the platform essentially along a direction perpendicular to the platform pivot axis (A1).

3. The apparatus according to claim 1 wherein the arm engaging means (84, 86) are also structured and arranged, in the stabilizing arm position, to engage the wall support arms (80) to prevent movement of the wall support arms (80) in relation to the platform (20) in a direction perpendicular to the platform (20).

4. The apparatus according to claim 1, wherein each wall support arm is provided with a wheel or a roller at said outer end of each wall support arm for engaging the wall in the use position of the apparatus, wherein said wheels or said roller at the outer ends of the wall support arms are arranged to rotate in a first direction against the wall when the apparatus is raised into said use position against the wall to be blocked or at least braked from rotating in an opposite second direction in order to prevent unintentional lowering of the platform.

5. The apparatus of claim 1, wherein the right-side stop means and the left-side stop means are attached to the first planar surface of the platform.

6. The apparatus of claim 1, wherein the right-side stop means and the left-side stop means are located at the right side and the left side of the platform, respectively.

7. The apparatus of claim 1, wherein the single central rotational stop member (84) includes a proximally extending extension (84A), which, in the stabilizing arm position, extends over each of the right wall support arm and the left wall support arm (80), thereby preventing vertical movement of the wall support arms 80 in relation to the platform (20).

8. The apparatus of claim 1, wherein the single central rotational stop member is positioned at the distal side of the platform.

* * * * *